US009555435B2

(12) United States Patent
Pfeifle et al.

(10) Patent No.: US 9,555,435 B2
(45) Date of Patent: Jan. 31, 2017

(54) APPARATUS WTIH PAD HAVING A FABRIC STRUCTURE TO APPLY A LIQUID

(75) Inventors: Marcus Pfeifle, Schwabmuenchen (DE); Tobias Popp, Hirshaid (DE)

(73) Assignee: CTP GmbH, Schwabmunchen (DE)

( * ) Notice: Subject to any disclaimer, the term of this patent is extended or adjusted under 35 U.S.C. 154(b) by 215 days.

(21) Appl. No.: 13/821,639

(22) PCT Filed: Sep. 8, 2011

(86) PCT No.: PCT/EP2011/065559
§ 371 (c)(1),
(2), (4) Date: May 6, 2013

(87) PCT Pub. No.: WO2012/032121
PCT Pub. Date: Mar. 15, 2012

(65) Prior Publication Data

US 2013/0224384 A1 Aug. 29, 2013

(30) Foreign Application Priority Data

Sep. 8, 2010 (DE) ..... 10 2010 037 401

(51) Int. Cl.
*B05C 1/06* (2006.01)
*D21F 1/32* (2006.01)
(Continued)

(52) U.S. Cl.
CPC . *B05C 1/06* (2013.01); *D21F 1/32* (2013.01); *D21G 3/00* (2013.01); *B05C 1/003* (2013.01); *B05C 17/002* (2013.01); *B41F 35/00* (2013.01)

(58) Field of Classification Search
CPC ..... B05C 1/06; B05C 1/0813; B05C 1/0817; B05D 1/28; B41P 2235/23; B41P 2235/26; B41F 35/00; B41J 29/17
See application file for complete search history.

(56) References Cited

U.S. PATENT DOCUMENTS 1,196,437 A * 8/1916 Doyle ..... B41F 35/06 101/425
1,378,278 A * 5/1921 Roberts ..... B41F 35/00 101/424
(Continued)

FOREIGN PATENT DOCUMENTS

DE 280050 A1 6/1990
DE 4105674 A1 8/1992
(Continued)

OTHER PUBLICATIONS

Search Report issued by German Patent Office dated Jan. 28, 2011.

*Primary Examiner* — Karl Kurple
(74) *Attorney, Agent, or Firm* — Douglas Denninger

(57) ABSTRACT

An apparatus and a method for applying a liquid active substance to surfaces moving in a circulating manner, such as of cylinders, rolls, fabrics or other moving webs, consisting of a metering unit and an application unit. The active substance is conducted to the application unit by the metering unit, and the application unit has a pad with an open-pore mesh structure for receiving and storing the active substance and for applying the active substance as a film as a function of the degree of saturation and the contact pressure of the pad on the moving surface. Also, the use of the apparatus for keeping moving surfaces free from deposits, accumulations or contaminants.

22 Claims, 16 Drawing Sheets

(51) Int. Cl.

| | |
|---|---|
| ***D21G 3/00*** | (2006.01) |
| *B05C 17/00* | (2006.01) |
| *B41F 35/00* | (2006.01) |
| *B05C 1/00* | (2006.01) |

(56) References Cited

U.S. PATENT DOCUMENTS 1,890,599 A * 12/1932 Cobello ..... A45D 34/042 132/74.5
2,011,635 A * 8/1935 Homan ..... D06F 43/002 401/148
2,790,191 A * 4/1957 Johnson ..... A47L 13/18 15/227
2,919,455 A * 1/1960 Turner ..... A47K 11/10 15/210.1
2,987,748 A * 6/1961 Baliol ..... 15/256.51
3,014,833 A 12/1961 Lee
3,084,069 A * 4/1963 Werner ..... B05B 3/02 118/201
3,393,963 A * 7/1968 Nadai ..... 401/207
3,811,783 A * 5/1974 Johnson ..... A46B 11/0013 401/10
4,090,642 A * 5/1978 Baker ..... B65D 75/327 206/221
4,686,902 A * 8/1987 Allain ..... B41F 35/06 101/424
5,171,095 A * 12/1992 Davies ..... A43D 25/183 401/209
5,265,537 A * 11/1993 Gasparrini ..... B41F 35/06 101/423
5,657,693 A * 8/1997 Kumaki ..... B41F 35/006 101/423
6,073,389 A * 6/2000 Piccolo ..... A01G 7/06 47/1.5
6,141,813 A * 11/2000 De Guzman ..... A47L 13/144 15/119.2
6,190,077 B1 * 2/2001 Newson ..... A01M 21/043 401/192
6,547,880 B1 * 4/2003 Krueger ..... B05C 1/06 118/264
6,557,470 B1 * 5/2003 Persson ..... B41F 35/06 101/424
6,799,514 B2 * 10/2004 Boatman ..... B41F 35/02 101/424.1
7,004,659 B1 * 2/2006 Goodman ..... B05C 17/002 222/633
7,988,376 B2 * 8/2011 Todd ..... A01M 21/043 401/183
8,719,996 B1 * 5/2014 Brauns ..... B08B 1/02 15/256.51
2001/0013296 A1 * 8/2001 Ghisalberti ..... B41F 35/00 101/424
2006/0127157 A1 6/2006 Sims
2007/0134051 A1 * 6/2007 Todd ..... 401/205
2009/0120363 A1 * 5/2009 Koishi et al. ..... 118/715
2009/0250001 A1 * 10/2009 Tognetti ..... B24B 5/366 118/255
2010/0218909 A1 9/2010 Gauvin et al.
2011/0056039 A1 * 3/2011 Suzuki ..... B41F 35/00 15/210.1
2012/0114866 A1 * 5/2012 Huck ..... B05D 1/26 427/429
2013/0108797 A1 * 5/2013 Rapin ..... B05D 1/40 118/264

FOREIGN PATENT DOCUMENTS

DE 10352865 B4 11/2005
EP 0757129 A1 2/1997
JP WO 2009131069 A1 * 10/2009 ..... B41F 35/00
WO 9118146 A1 11/1991
WO 9827279 A1 6/1998
WO 0010733 A1 3/2000

* cited by examiner

APPARATUS WTIH PAD HAVING A FABRIC STRUCTURE TO APPLY A LIQUID

RELATED APPLICATIONS

This application claims the filing benefit of International Patent Application No. PCT/EP2011/065559, filed Sep. 8, 2011, which claims the filing benefit of German Patent Application No. 10 2010 037 401.6 filed Sep. 8, 2010, the contents of both of which are incorporated herein by reference.

TECHNICAL FIELD OF THE INVENTION

The present invention pertains to an apparatus for applying liquids on moving surfaces, a method for applying liquids and the utilization of the apparatus, in particular, for applying liquids onto rolls, screens, web loops or the like.

BACKGROUND OF THE INVENTION

In the manufacture of paper and cardboard or other web-shaped materials and during drying processes on surfaces, corrosion, incrustations, adhesive contaminations, deposits and dirt accumulations frequently occur on rolls, cylinders and fabric covers. The types of deposits and their composition may be very diverse and heavily depends on the raw materials used, as well as the corresponding process materials. In the paper industry, one frequently encounters, e.g., adhesive contaminations that are referred to as "stickies." The reasons for this type of deposits are usually the ingredients or constituents of the raw materials used. These usually consist of adhesives, binders and dispersants.

When primary fibers materials are used, for example, resin particles, fibers and paper dust can coat and clog cylinders, rolls and fabric covers and, in particular, reduce the porosity of the latter.

Among other things, deposits of any type on rolls, cylinders and fabric covers create problems during the manufacture. These problems result in standstill and cleaning times, production downtimes and output losses. Furthermore, deposits on drying cylinders used in the manufacture of paper or cardboard deteriorate the heat transfer and therefore cause significant energy losses during the drying process.

In the prior art, the deposits are removed during a machine standstill with the aid of cleaning chemicals, high-pressure cleaners and scrapers. Acidic and alkaline cleaning agents are used for this purpose. These cleaners can lead to corrosion, as well as infiltrate the bearing housings of the rolls and thusly lead to damages of the bearings. In addition, the utilization of these aggressive cleaning agents may, if applicable, be questionable with respect to occupational safety considerations and at least sufficient protective gear needs to be provided for the cleaning personnel.

When the components are sprayed with acidic and alkaline cleaners, the inhalation of the aerosols furthermore represents a health hazard for the personnel.

According to another option, the fabric covers, e.g., in a paper/cardboard machine or another system for manufacturing web-shaped materials are subjected to a continuous high-pressure cleaning process. In this case, water is sprayed on the fabric covers under high pressure. Deposits should be removed from the fabric covers in this way. One problem in this respect is the location of these units. At temperatures in excess of 100° C., the environment puts very high demands on the technology. This results in system failures and an increased service effort. Even undesirable remoistening of the web may occur. If the system fails, it can only be repaired again during a machine standstill. The fabric cover may become damaged due to the high water pressure. The service life of the fabric cover is therefore reduced.

A passivation product is sprayed on according to yet another option. However, this also requires a traversing nozzle. The ambient conditions also put very high demands on the technology in this case in order to prevent a failure of the nozzle. Only very little installation space is frequently available within the machine or another system for the manufacture of web-shaped materials. A certain cross section of the cross head is also required due to static requirements. However, the installation of the cross head then frequently interferes with other production operations.

Since the product is sprayed on from a certain distance and the cylinders and fabric covers rotate with very high peripheral speeds, significant atomization of the product occurs within the machine or another system. This leads to undefined spraying of the product within the machine. The aerosols being created may represent a health hazard for the personnel.

In consideration of this prior art, the present invention is based on the objective of at least partially eliminating the known disadvantages of the prior art.

SUMMARY OF THE INVENTION

This objective is attained with an apparatus for applying a liquid active substance. Preferred embodiments of the claimed invention form the objects of the respective dependent claims.

The inventive apparatus for applying a liquid active substance onto a surface that preferably moves rotationally comprises at least one metering unit and one application unit. The invention is characterized in that the metering unit conveys the active substance to the application unit, in which the active substance is received and stored, as well is applied onto the moving surface, by a pad. In this case, the pad is preferably realized in the form of an open-pore mesh structure and forms a film on the moving surface in dependence on the type and pressure of the active substance metering, the porosity of the pad, the degree of saturation and the contact pressure on the moving surface.

In this context, the moving surfaces refer, in particular, to surfaces of cylinders, rolls and fabric covers, for example, of the type used in the paper industry. However, the scope of the present invention also includes embodiments, for example, in which moving plastic or metal strips form a corresponding surface and can be treated accordingly.

The liquid active substance applied onto a moving surface by means of the inventive device is a composition that is selected from a group containing water or mixed solvent systems, e.g., with aliphatic and/or aromatic, linear and/or cyclic, polar and/or non-polar solvent fractions, salts of monovalent or multivalent ions, acids and/or alkaline solutions, aqueous and oleiferous liquids, particularly saturated or unsaturated, open-chain or cyclic, normal or isomeric hydrocarbons, polymeric linear and/or cyclic alkyl siloxanes and alkyl aryl siloxanes and/or aryl siloxanes and/or their copolymers and/or cationic or quaternary and/or amphoteric silicone products and/or silicone derivatives, silicone oils, silicone greases, silicone tensides, silicone oil dispersants, silicone fluids, polydimethyl siloxane, polymethyl phenyl siloxane, oleiferous suspensions, oil emulsions, oil-in-water emulsions, water-in-oil emulsions, mineral oil, natural oils and fats, vegetable oil, animal oil such as, e.g., castor oil, coconut oil and/or tall oil and/or their derivatives, primary, secondary and tertiary or linear and/or branched, aliphatic and/or aromatic alcohols and/or ethers and/or esters derived thereof, betaines, lecithins, phospholipids, protein solubilisates and/or modified products thereof, wax emulsions, anionic, nonionic, amphoteric and/or cationic tensides, anionic, nonionic, amphoteric or cationic tenside-like and/or polymeric fluoric compounds, primary, secondary and tertiary alkyl amines and/or alkyl aryl amines, diamines and/or polyamines, alkyl and alkyl aryl amino oxides, imidazolinones and morpholines, quaternary ammonium compounds, if applicable, also ethoxylated, saturated and/or unsaturated fatty acids and/or their salts with monovalent and/or multivalent cations, esters, amines and/or amides of saturated and/or unsaturated fatty acids and/or fatty alcohols, alkyl and/or alkyl aryl phosphates, phosphonates, sulphates and sulphonates, alkyl ether and/or alkyl aryl ether phosphates and/or sulphates, alkyl and/or alkyl aryl sorbitans and/or polyols and glycerides, alkyl and/or alkyl aryl polyglycol ether and/or ester, wetting agents, antistatic agents, antifriction agents, lubricants, emulsifiers, lipophilic and hydrophilic cleaning agents, lipophilic and hydrophilic solvents, alcohols, saturated fatty alcohols, unsaturated fatty alcohols, saturated fatty acids, unsaturated fatty acids, fatty-acid monalkyl esters, fatty-acid amides, fatty-acid monoalkyl amides, monoesters or polyesters of saturated or unsaturated monovalent or multivalent carboxylic acids, wax alcohols, glycols, benzene, isopropanols, toluene, aliphatic compounds, glycerides, as well as anionic, non-ionic, amphoteric and/or cationic synthetic and/or natural polymers in dissolved and/or dispersed form, homo-polymerized and/or co-polymerized polyamines, polyesters, polyacrylates and/or polyalkylene glycols and/or alkyl polyglycols, combinations thereof and the like. Furthermore, anticorrosive agents, biocides and activators and/or catalysts and reactive precursors of release products that can be activated with UV-light and electron beams may be applied.

According to the present invention, the term metering unit refers, in particular, to a feed system for the active substance. According to a particularly preferred embodiment, the metering unit comprises a pipe or conduit system for the liquid active substance that extends, for example, from a reservoir to the application unit and serves, in particular, for supplying the pad with the liquid active substance. For this purpose, the pipe system features at least one porous section or (transverse) openings, in particular, in the region of the pad in order to introduce the active substance into the pad. According to a particularly preferred embodiment, the porous sections or openings are distributed, in particular, uniformly over the length of the pad in order to achieve a uniform saturation thereof. The metering may alternatively also be varied over the length of the pad, for example, in order to apply more or less active substance in the zones of the moving surface that are more prone to contaminations or deposits.

According to another particularly preferred embodiment, the metering unit comprises a feed device, by means of which the liquid active substance is continuously conveyed to the application unit. However, the scope of the present invention also includes embodiments, for example, in which the pad is only supplied with the active substance intermittently such that only a certain quantity of the active substance is applied onto the surface.

According to another particularly preferred embodiment, the metering unit comprises a pipe or conduit system, in which an excessive amount of the liquid active substance is fed through a first conduit and the remainder of the liquid active substance not dispensed to the pad is returned, in particular, into a reservoir through a second conduit.

In this embodiment, the liquid active substance is preferably pumped or circulated in a circuit, wherein the reservoir is for this purpose equipped with a tempering device and/or a mixing device. Among other things, the accuracy of the mixing ratio and of the temperature of the supplied liquid active substance is respectively increased or adjusted in this way.

According to the present invention, the term pad refers to a body that is manufactured, in particular, of threads, cords, strands, particularly woven fabrics, braided fabrics, layered fabrics, compressed fabrics or meshes thereof, has an open-pore mesh structure and, according to a particularly preferred embodiment, is realized in the form of a sponge, felt, non-woven fabric, combinations thereof and the like.

According to another embodiment, the pad may consist of at least two parts, wherein the pad features, in particular, at least one hose with openings, around the outer side of which a fabric structure is arranged. This may be realized, for example, by arranging a fabric made of a material of the type used, for example, for packings (bushing seals) in industrial applications around a PTFE hose with round or angular cross section. Such seals are predominantly made on the basis of materials such as, for example, graphite, iron, steel and/or asbestos, namely of aramide fibers, glass fibers, carbon fibers and/or PTFE fibers. Due to the utilization of such a material, the abrasion characteristics of the pad can also be adapted to the corresponding operating conditions.

Alternatively, the pad may also consist of a core material, into which a flow path with openings for the fluid/active substance is integrated and around which a fabric structure is arranged.

With respect to the alignment of the openings, it should be noted that they do not necessarily have to be aligned toward the contact side of the pad with a surface to be coated, but rather can be arranged in any direction depending on the material/fabric used. In this respect, the alignment toward the rear side of the pad, in particular, also seems to promote a uniform distribution of the fluid.

According to another particularly preferred embodiment, the pad is accommodated in a mounting and non-positively, frictionally, positively and/or integrally connected thereto.

According to another particularly preferred embodiment, at least individual sections of the metering unit are also accommodated in the mounting of the pad, wherein the metering unit or the pipe or conduit system is preferably arranged on the rear side of the pad, i.e., on the side of the pad that faces away from the moving surface. Alternatively, sections or even the entire pipe system in the region of the pad may also be integrated therein.

A feed line may alternatively be arranged parallel to the pad, wherein the fluid/active substance conveyed in this feed line is introduced into the pad via discharge lines. In this respect, it would be possible, in particular, to utilize needle-shaped discharge lines that are arranged at a predefined distance from one another along the principal direction.

According to another preferred embodiment, the inventive apparatus is connected with or to a support system, particularly a cross head, that preferably extends over and, if applicable, beyond the entire width of the moving surface. When processing broad widths in excess of ten meters, this provides the particular advantage that the inventive apparatus can be supported in such a way that a deflection of the apparatus can be prevented or at least compensated. In this context, it needs to be taken into consideration that the application unit should be arranged as evenly as possible over the entire web width, in particular, so as to ensure a uniform film application.

According to another particularly preferred embodiment, the inventive apparatus is combined with at least one cleaning system, particularly a scraper or scraper system. According to a first variation, the application unit and the cleaning system are jointly arranged on a cross head, wherein the respective connection between the cross head and the application unit or the cleaning system is produced with a correspondingly configured adapter. A separate arrangement, for example, on two cross heads would alternatively also be conceivable. According to another particularly preferred embodiment, the cleaning device furthermore is arranged in front of the application unit referred to the moving or rotating direction of the surface. In this way, particularly damages of the application unit and the pad can be respectively prevented or at least reduced.

According to another preferred embodiment, at least the application unit is arranged such that it can be pivoted relative to the surface about a pivoting axis. Furthermore, the cleaning system may also be arranged such that it can be pivoted about either a separate axis or a common axis referred to the application unit.

According to another particularly preferred exemplary embodiment, the application unit is furthermore placed or pressed against the moving surface about the axis by means of a pressing system such as, for example, a pressure application or load application hose, wherein the application unit is lifted off, for example, by means of a lift-off spring that is prestressed by the pressing system in the contacting state and therefore lifts off the application unit when the contact pressure is reduced. Alternatively, a hydraulic or pneumatic system may also be used for the lift-off spring. This also applies accordingly to the pressing system that, according to a particularly preferred embodiment, consists of a load application hose that is fixed in a u-shaped fashion and inflated with air, particularly compressed air, in order to place the application unit against the moving surface.

According to another particularly preferred embodiment, sheet metal or metal strips that are folded once or several times are respectively used as lift-off spring, wherein these sheet metal or metal strips are prestressed accordingly at least when the application unit is placed against the moving surface and generate a corresponding restoring force. In this context, it needs to be taken into consideration that these lift-off springs may be realized in the form of pressure springs, as well as in the form of tension springs, depending on the respective application and arrangement. The lift-off spring preferably serves for ensuring that the application unit lifts off the moving surface, e.g., when the pressure in the load application hose drops.

According to another particularly preferred embodiment, the application unit and/or the cleaning system, particularly the scraper, are respectively arranged on or placed against the moving surface in a spring-loaded fashion.

According to another preferred embodiment, at least the application unit and/or the cleaning system are respectively arranged such that they can be transversely moved relative to the surface along at least one longitudinal axis, as well as driven such that they can be moved back and forth over the web width to a predetermined extent, particularly in a continuous fashion. This longitudinally directed motion, in particular, of the application unit is also referred to as traversing and serves for promoting a uniform film application or for improving the quality of the film application. Hydraulic drives, particularly also longitudinal drives, may be used for this purpose in addition to electric motors.

According to another particularly preferred embodiment, the application unit, particularly the pad of the application unit, is arranged relative to the moving surface in such a way that the distance between the pad area facing the surface and the moving surface is greater than the distance between the scraper and the moving surface in the lifted-off state.

Due to the respective arrangement of the application unit and the cleaning system on a base plate that preferably forms part of the cross head, it is possible to arrange the application unit, as well as the cleaning system, in such a way that it can be laterally removed above the moving surface. This provides particular advantages with respect to exchanging, retrofitting and installing the corresponding apparatus or the system, respectively.

This can be realized, in particular, with an exchanging and fixing rail that allows the longitudinal displacement due to a corresponding profile and fixes the inserted unit in at least one position, if applicable, by utilizing auxiliary elements.

According to another particularly preferred embodiment, the inventive application unit is respectively segmented or divided into individual sections over the width of the moving web. Due to this measure, in particular, a differentiated application of the active substance can be achieved over the width of the moving surface.

The objectives of the present invention may be also attained with a method, in which the application of a liquid active substance onto a moving surface is carried out by means of the above-described apparatus and which comprises the steps of saturating the application unit, particularly the pad, with the liquid active substance, placing the application unit against the moving surface in order to produce a film and subsequently lifting off the application unit.

According to another particularly preferred embodiment, the inventive method furthermore comprises a continuous feed of the liquid active substance to the application unit, particularly to the pad, wherein the liquid active substance is according to another particularly preferred embodiment conveyed in a circuit and tempered and/or mixed, particularly in a reservoir. This is realized, in particular, by means of a pipe system with at least two pipes or conduits, at least one of which is used as flow pipe and one of which is used as return pipe.

According to another particularly preferred embodiment, the method comprises a control in order to ensure that the application unit is only placed against the moving surface after the cleaning device has been placed against the moving surface if the application unit is combined with a cleaning device.

The present invention furthermore pertains to the utilization of the above-described inventive apparatus and method for keeping moving surfaces of cylinders, rolls, fabric covers (for example screens, particularly wet screens and dry screens) or other moving webs free from deposits, conglutinations, accumulations or contaminations, particularly as part of a device for respectively manufacturing paper, cardboard or paperboard or for manufacturing metal sheets or press boards.

Based on the above-described apparatus and method, the present invention is respectively intended for preventing or at least reducing deposits on rolls, cylinders and fabric covers, particularly in the manufacture of paper, cardboard and paperboard, and for thusly contributing to an improved operation of the paper or cardboard machine (runnability optimization) or another system for manufacturing fibrous materials. In this context, the present invention may be able to keep rotating rolls or cylinders or a moving web free from adhesions (stickies) and other contaminations or to at least reduce this adhesion or this contamination, preferably in paper machines or other web-fed machines. It is also particularly advantageous to respectively utilize the inventive apparatus and method for the treatment of calender bowls or calender rolls.

Another particularly preferred application of the present invention is the treatment of cylinder surfaces in drying sections. Due to the applied liquid active substance, the adhesion of fibers, fines, particles, fillers, conglomerates, extraneous materials and sticky substances respectively is prevented or at least reduced. This advantageously makes it possible, e.g., to increase the surface temperature of the cylinders such that the drying capacity of the system is increased accordingly. This in turn makes it possible, e.g., to increase the production speed, namely without the web adhering or sticking as it is the case in the prior art. This manifests itself in the form of an increased production.

Other advantages of the inventive apparatus can be seen in that the liquid active substance is not sprayed, that the installation mass is as small as possible and that, according to a preferred embodiment, the apparatus does not require, in particular, any electrical components such as, e.g., motors and therefore allows a maintenance-free operation under extreme ambient conditions.

If the application takes place onto the drying cylinders of a paper machine in order to increase the speed, a predefined temperature curve is normally adjusted. In this case, a lower surface temperature is adjusted in the first cylinders of a drying section in order to prevent an adhesion of the paper web on the cylinder and therefore picking of the paper web.

The application of the liquid active substance makes it possible, among other things, to operate with increased drying energy and therefore to adjust higher surface temperatures. This results in an increased drying capacity and an increased production capacity due to the increased speed.

The compact structural shape also makes it possible to install the invention under the very confined conditions frequently encountered in practical applications.

Due to the type of application, no aerosols are created that could be inhaled by the personnel. Hazards to the personnel therefore are precluded. The product is purposefully applied at the location, at which it is utilized.

Consequently, cylinders, rolls, fabric covers and web-shaped materials of all types can be effectively treated with a passivating agent by means of this system.

During corresponding tests, it was possible to apply a closed film onto the test cylinder. The metered amount can be varied with the pump capacity and the size of the bores. In addition, the application unit can be raised and lifted off in a cyclic fashion. Due to this measure, the metered application can be controlled in dependence on the respective requirements.

It is to be understood that the aspects and objects of the present invention described above may be combinable and that other advantages and aspects of the present invention will become apparent upon reading the following description of the drawing and detailed description of the invention.

BRIEF DESCRIPTION OF THE DRAWINGS

Different embodiments of the invention are described in greater detail below, wherein it is expressly noted that the invention is not limited to the embodiments illustrated in the drawings.

In these drawings.

DETAILED DESCRIPTION OF THE PRESENT INVENTION

Figure 1A:
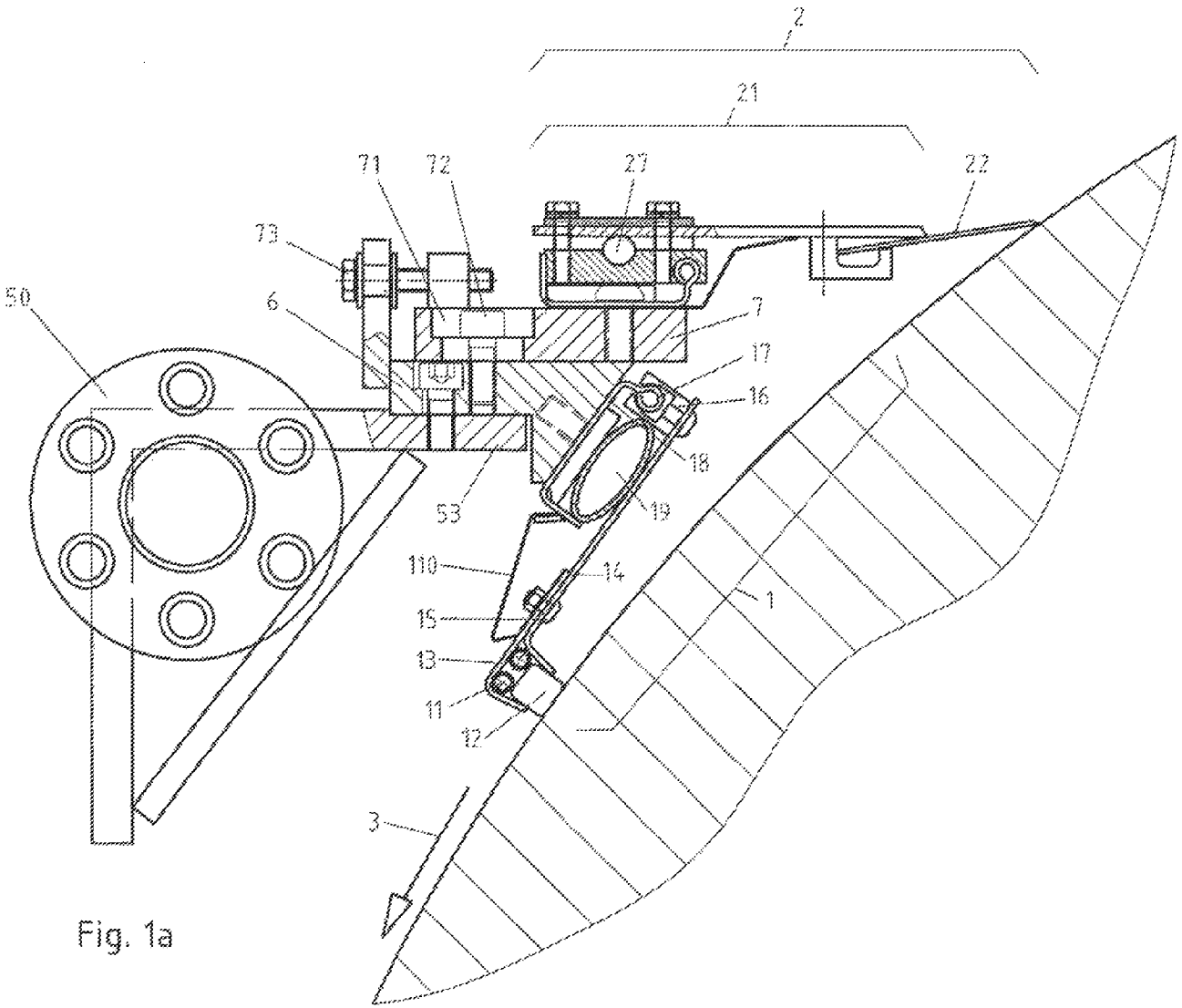
FIG. 1*a* shows a first embodiment of the application unit in combination with a cleaning system in the form of a scraper.

While this invention is susceptible of embodiment in many different forms, there is shown in the drawing and will herein be described in detail one or more embodiments with the understanding that the present disclosure is to be considered as an exemplification of the principles of the invention and is not intended to limit the invention to the embodiments illustrated.

According to the present invention, an application unit 1 applies a liquid active substance onto a roll or cylinder 3 (FIG. 1*a*) or onto a moving web (FIGS. 5 and 6) in the form of a film. This application unit 1 wets the circumferential surface of the rotating roll 3 or rotating cylinder or the surface of the moving web 4 in an essentially uniform fashion, wherein the liquid active substance alters the surface in such a way, in particular, that contamination particles or product remnants no longer adhere to the surface.

One preferred embodiment of the application unit 1 is the combination with a scraper system 2 such that mechanical cleaning of the roll surface is additionally realized in order to clean the surface to be maintained clear on the one hand and to keep contaminations away from the application unit on the other hand so as to ensure its function over a long period of time.

Figure 5:
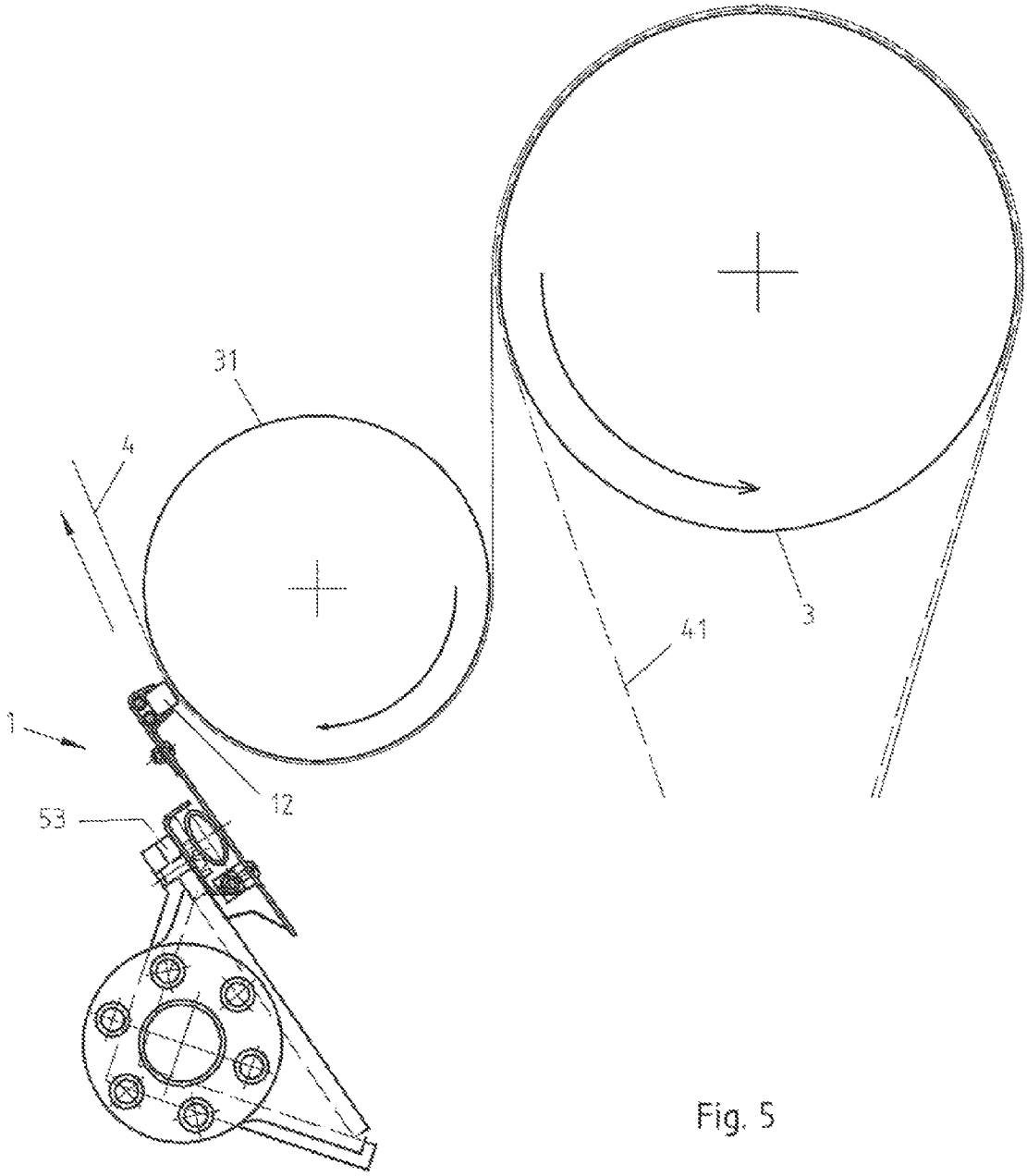
FIG. 5 shows another embodiment of the application unit in the state, in which it is placed against a fabric cover with roll.
Figure 6:
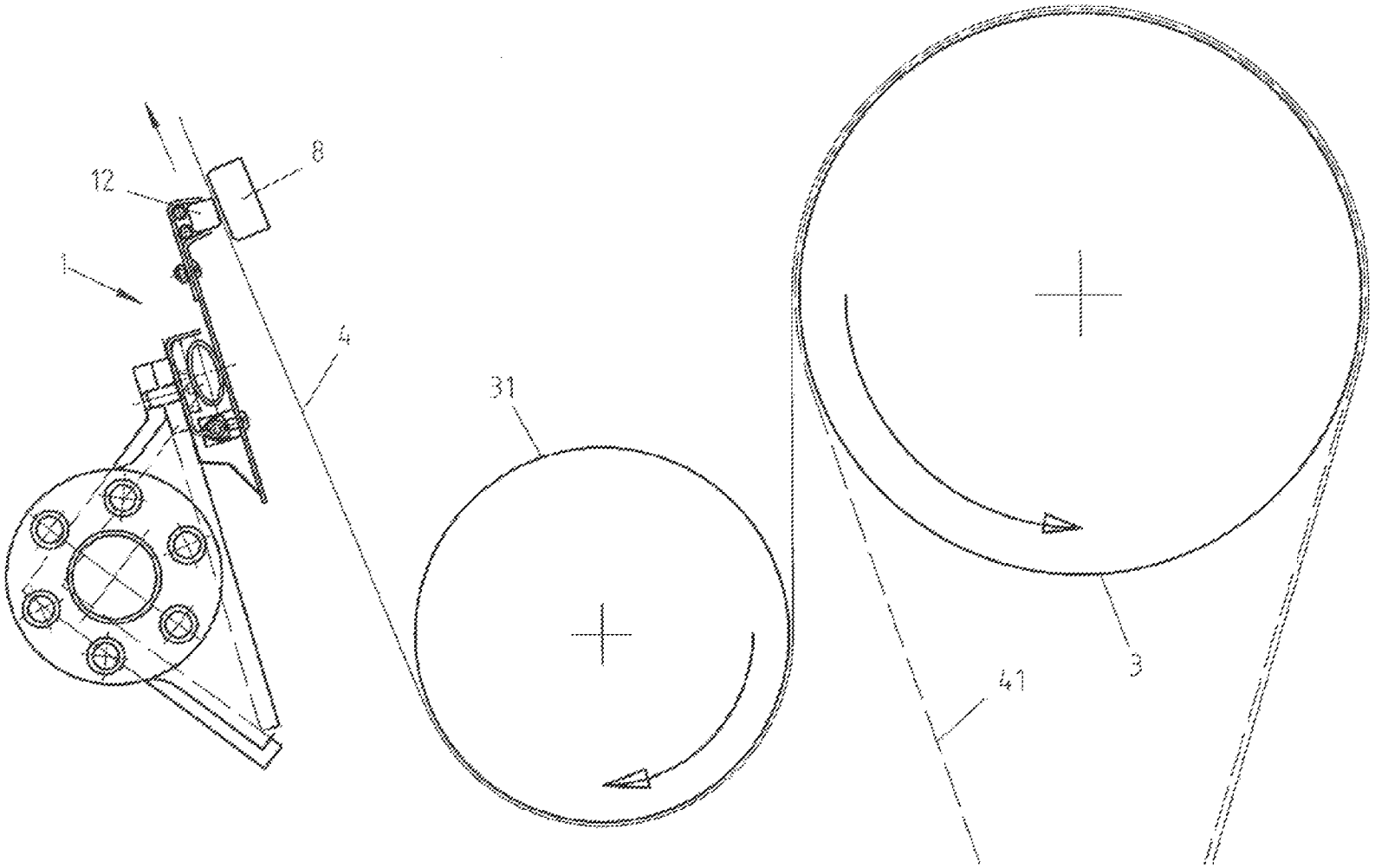
FIG. 6 shows another embodiment of the application unit in the state, in which it is placed against a fabric cover with counter element.

According to the present invention, a liquid active substance is fed to the application unit 1 through a hose or a pipe 11 and introduced into a pad 12, for example, through (not-shown) transverse openings. The pad 12 becomes saturated with the supplied liquid active substance and applies this active substance onto the surface, for example, of the roll 3 or the web 4 (FIGS. 1*a*, 5 and 6).

According to the embodiment shown, the application unit 1 comprises a metering unit, the hoses or pipes 11 of which are accommodated together with the pad 12 in a mount consisting, in particular, of two angle brackets 13 and 14 that can be displaced relative to one another, wherein the pad 12 and the hoses/pipes 11 are fixed in a working position when the angle brackets are pushed together and the two angle brackets 13 and 14 are pulled apart in order to exchange, clean or inspect the hoses or pipes 11 and the pad 12. The two angle brackets are fixed in the respectively desired position by means of screws 15 that are screwed into oblong holes. One limb of one angle bracket is connected to one or more bearings 16 that together with an axle 17 extending parallel to the roll or cylinder axis form a hinge, about which the application unit 1 can be pivoted, such that the pad 12 can be respectively placed against or lifted off the roll or cylinder 3 or the web 4 (FIG. 1*a*).

According to the embodiment shown, the axle 17 is realized in the form of a rod and mounted on the base plate 18 by means of the bearing 16. Since the axle 17 is realized as part of the base plate 18, the application unit 1 can be laterally pulled out of the apparatus on this axle 17.

According to the embodiment shown, the application unit 1 is placed against the moving surface by means of a load application hose 19 that is acted upon with compressed air or another medium. The application unit is lifted off by means of a lift-off spring 110 or alternatively by means of a lift-off hose. The lift-off spring consists, for example, of a sheet metal strip 110 that is folded once or several times, as well as rigidly clamped in position on one end and in springable contact on the other end (FIG. 1*a*).

According to the embodiment illustrated in FIG. 1*a*, the apparatus features a scraper unit 2 upstream of the application unit 1 referred to the moving direction. The scraper unit 2 consists of at least one scraper holder 21 and a scraper blade 22. The scraper holder 21 respectively makes it possible to place and pivot the scraper blade 22 against and away from the rotating roll 3 or rotating cylinder 3.

According to this illustration, the scraping device and the application unit are mounted on a common beam 50, wherein the positions of the application unit and of the scraping device can be shifted relative to one another. The illustration shows that this embodiment is also suitable for being subsequently installed on an already existing scraper beam 50 instead of the old scraper holder. For this purpose, an adapter rail 6 is used in order to hold the application unit 1 in a suitable position relative to the roll or cylinder 3 or to the web 4. A second adapter rail 7 is realized with oblong holes 71, mounting screws and adjusting screws 73 such that it can be displaced in order to adjustably position the scraper holder 21.

Figure 1B:
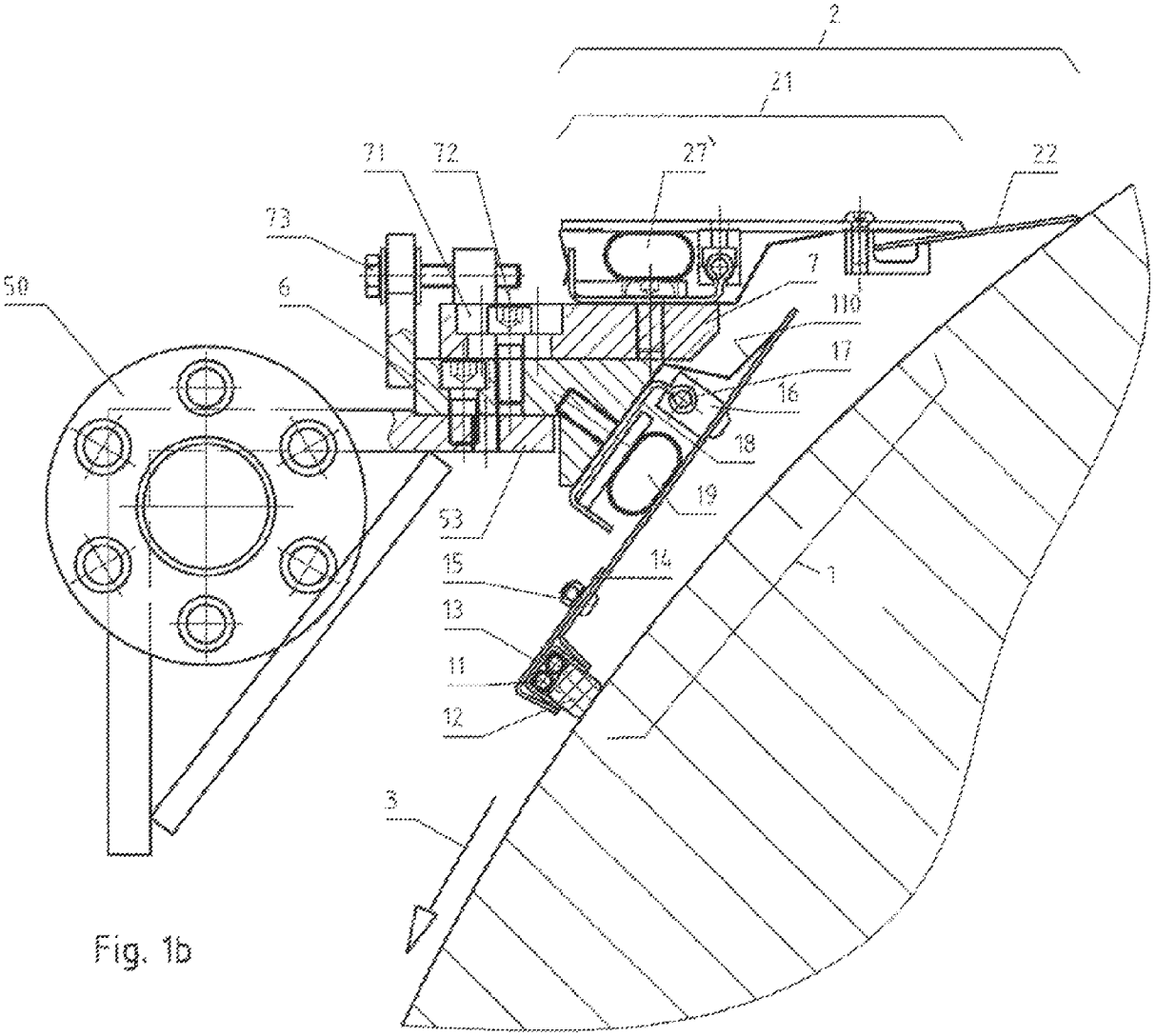
FIG. 1*b* shows an alternative embodiment of the application unit in combination with a scraper according to FIG. 1.

FIG. 1*b* shows an alternative embodiment of the apparatus, in which particularly the contact pressure of the scraper is not generated by a spring, but rather by a hose 27'. In FIG. 1*b*, the same reference symbols as in FIG. 1*a* were used for corresponding components. This also applies accordingly to the figures described below.

Figure 2:
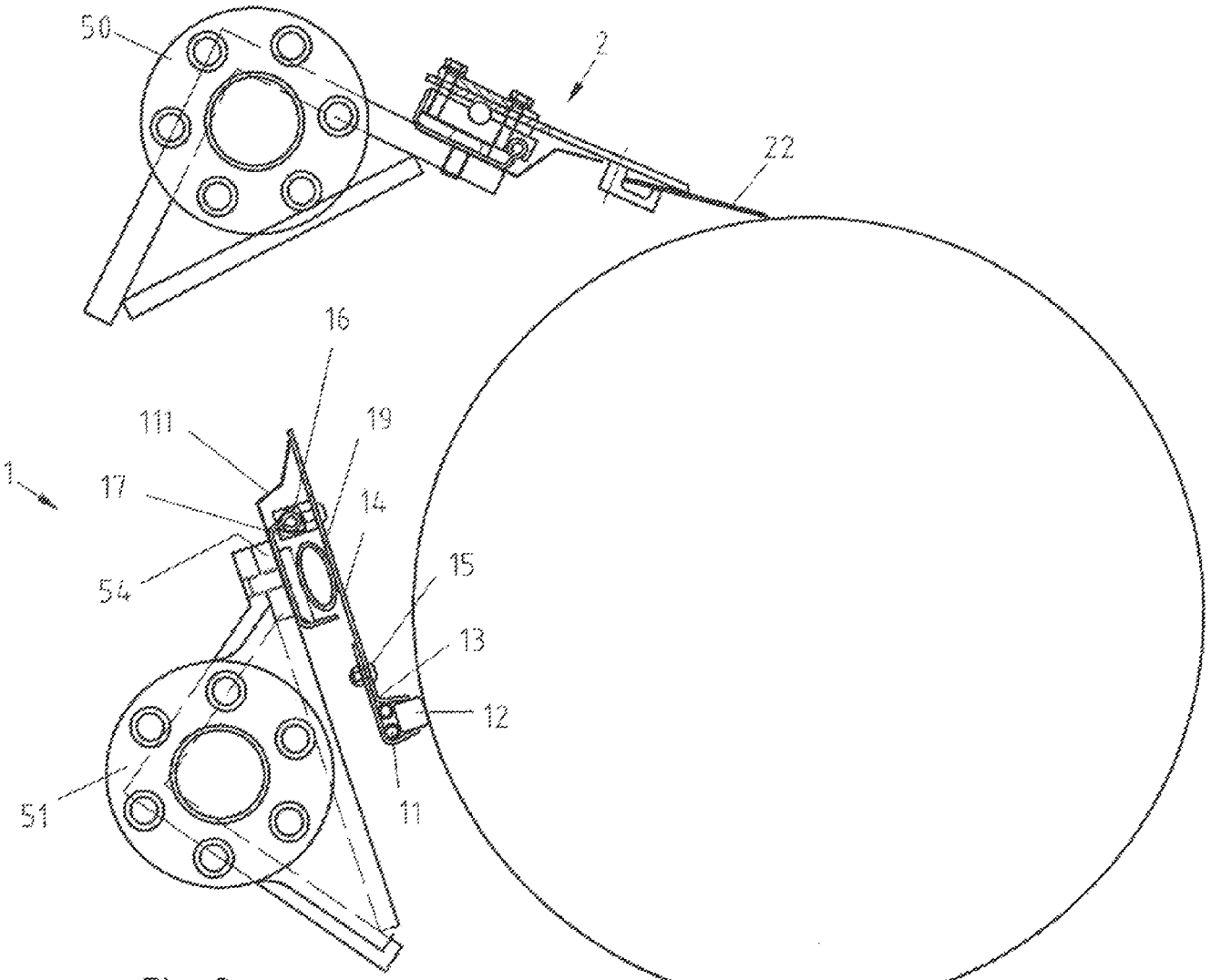
FIG. 2 shows a second embodiment of the application unit with a cleaning system in the form of a separately arranged scraper.

FIG. 2 shows an alternative embodiment of the application unit, in which the lift-of spring 111 is arranged opposite of the pad 12. According to the embodiment illustrated in FIG. 2, the scraping device 2 and the application unit 1 are mounted on separate beams 50 and 51 and the position and distance of each beam from the roll or cylinder 3 or from the web 4 can be individually adjusted. However, it should also be noted that particularly the beam 51 that may also be realized in the form of a cross head can in this particular embodiment be turned by 180° and would in this situation the aligned, for example, in the direction of the scraper beam. In this context, however, it basically needs to be taken into consideration that the scraping device 2 and the application unit 1 consist of separate components that are independent of one another with respect to their position relative to the roll.

Figure 3B:
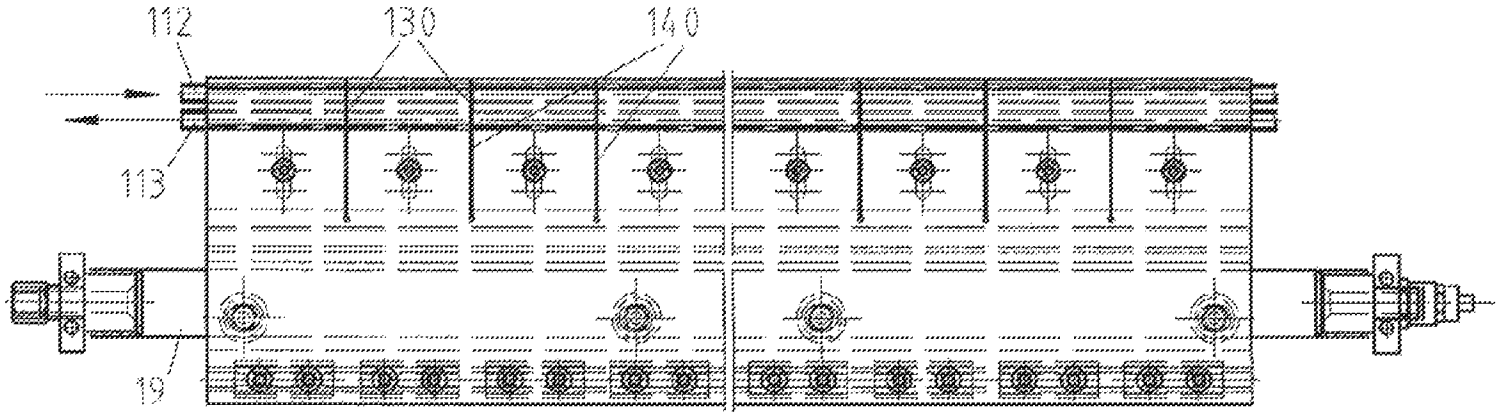
FIGS. 3*a* and 3*b* show detailed illustrations of the application unit in the form of a side view and a top view.
Figure 3A:
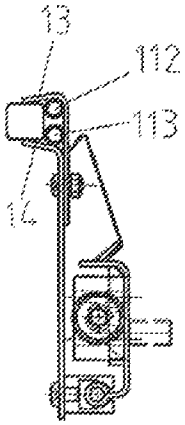

According to the embodiment illustrated in FIGS. 3*a* and 3*b*, one or both angle brackets 13 and 14 are segmented by means of slots 130 and 140 or in the form of individual sections, in particular, so as to achieve an increased flexibility in the direction of the roll or cylinder axis and/or transverse to the web.

The figures furthermore show the circulating arrangement of the metering device, in which a feed pipe 112 and a return pipe 113 are arranged and connected on the right side in accordance with the illustration in FIG. 3*b*.

Figure 3C:
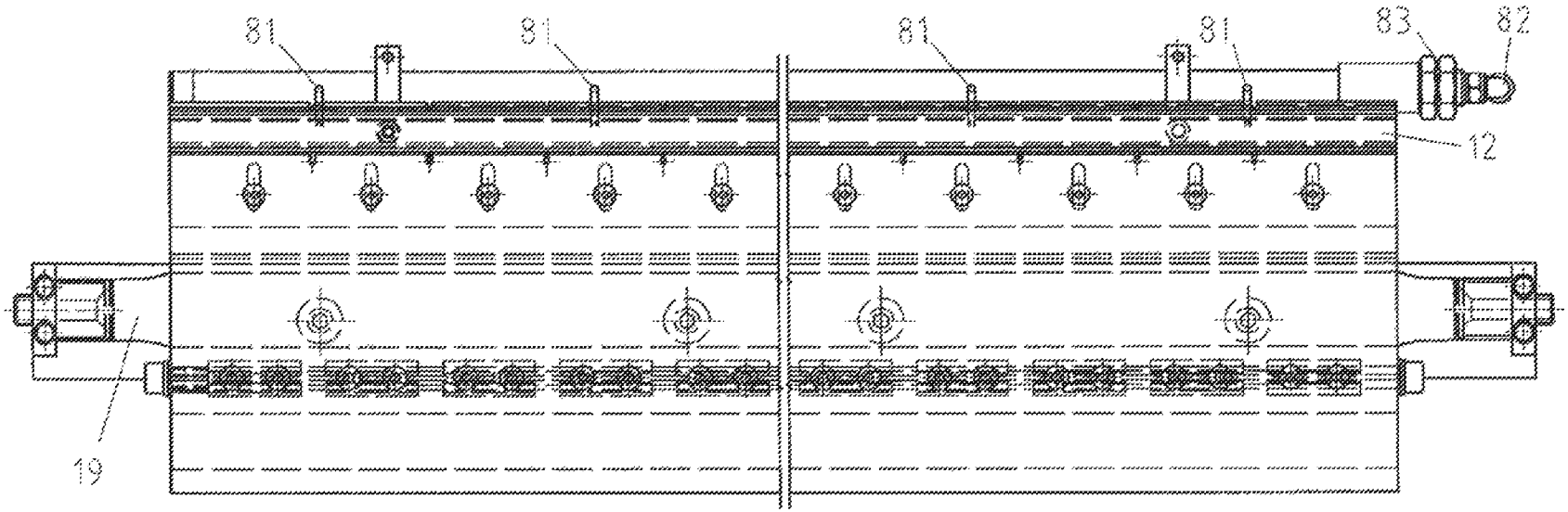
FIG. 3*c* shows a top view of an alternative application unit of the type illustrated in the form of a side view in FIG. 8*a;*
Figure 8A:
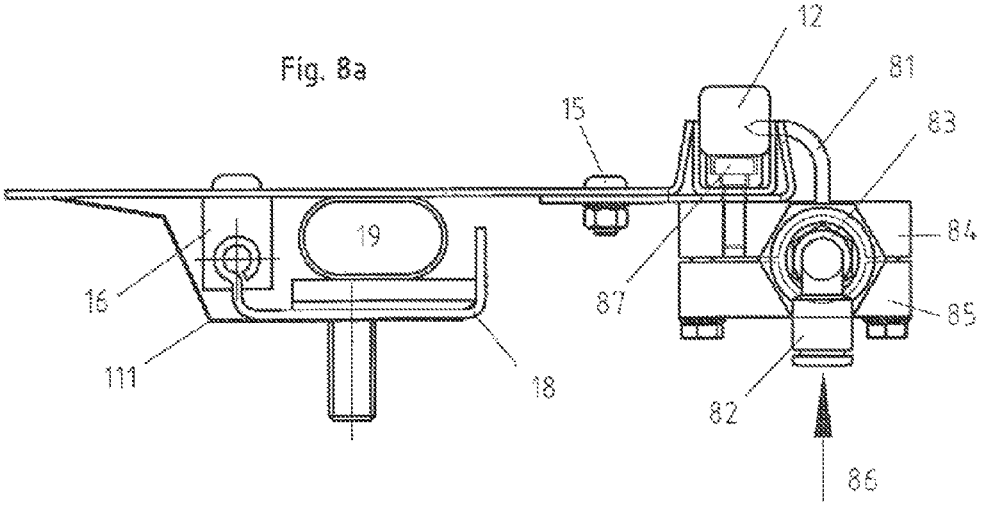
FIGS. 8*a* and 8*b* respectively show side views of another application unit with a fixed application element and with an exchanging rail for the application element.

FIG. 3*c* shows a top view of an alternative application unit of the type illustrated, among other things, in the form of a side view in FIG. 8*a*. The needle-shaped discharge lines 81, the feed line 82, the screw fitting of the feed line 83 and the pad 12 are also illustrated in this figure.

Figure 4B:
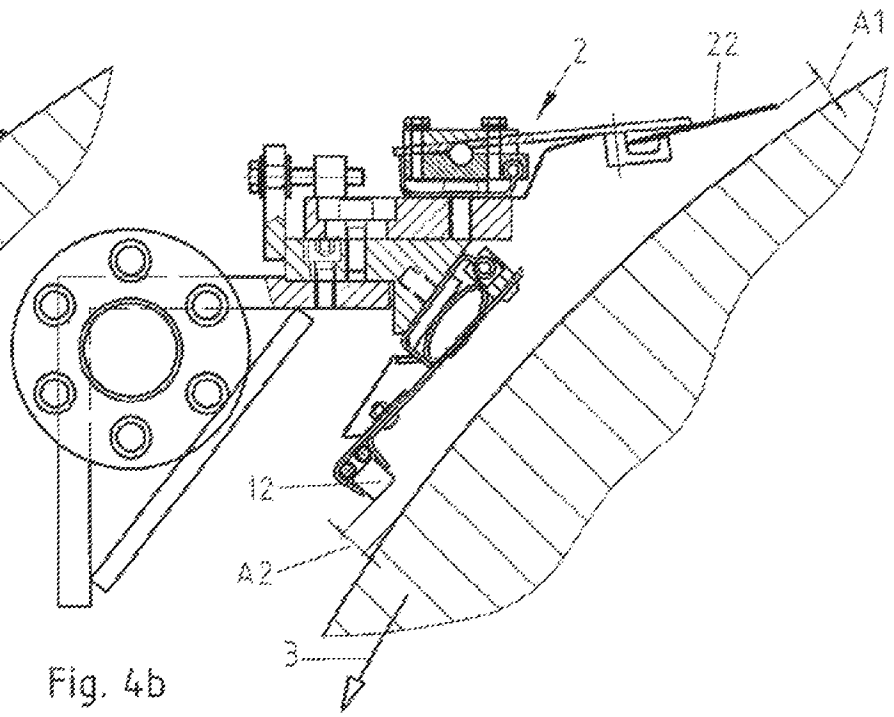
FIGS. 4*a* and 4*b* show illustrations of the embodiment according to FIG. 1*a* in the respective states, in which the application unit is placed against and lifted off the moving surface.
Figure 4A:
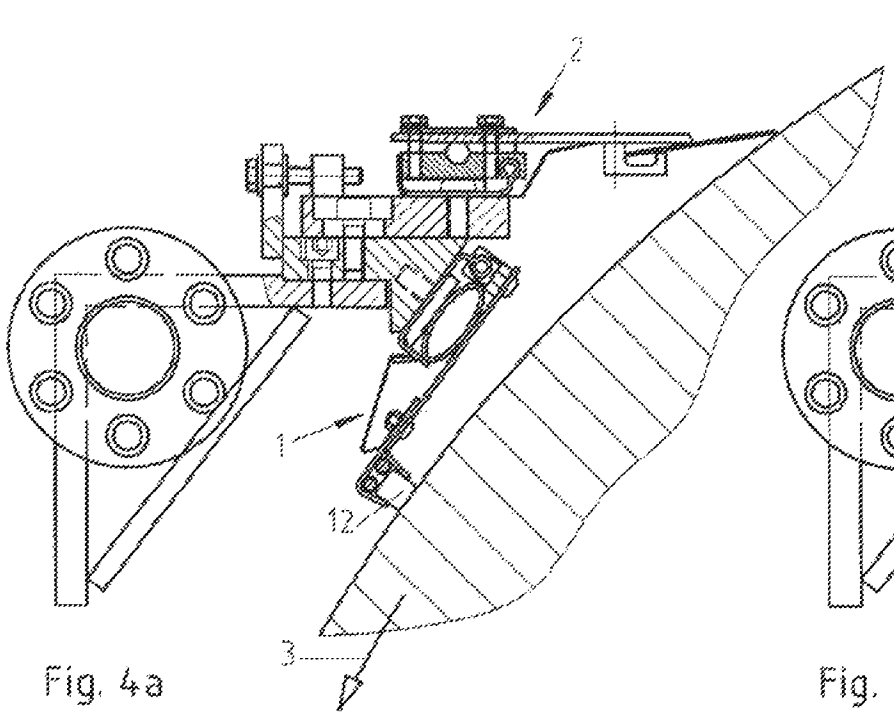

FIGS. 4*a* and 4*b* show the arrangement of the apparatus according to FIG. 1*a* in the respective states, in which it is placed against and lifted off the moving surface. The adjusting options in the lifted-off position 4*b* make it possible to adjust the distance A1 of the scraper blade 22 from the roll or cylinder 3 or from the web 4 (FIG. 5 or 6) smaller than the distance A2 of the pad 12 from the roll or cylinder 3 or from the web (not illustrated in this figure). Consequently, particularly large foreign bodies that pass the scraper blade 22 on the surface to be cleaned in its moving direction while the scraper blade is lifted off can also pass the pad 12 without causing damages thereof. Foreign bodies with such a size that they cannot pass the lifted-off scraper blade 22 are kept away from the scraper blade and consequently also from the pad 12 such that the scraper system 2 protects the pad from contaminations and foreign bodies in the position, in which it is placed against the moving surface, as well as in the lifted-off position.

Figure 4D:
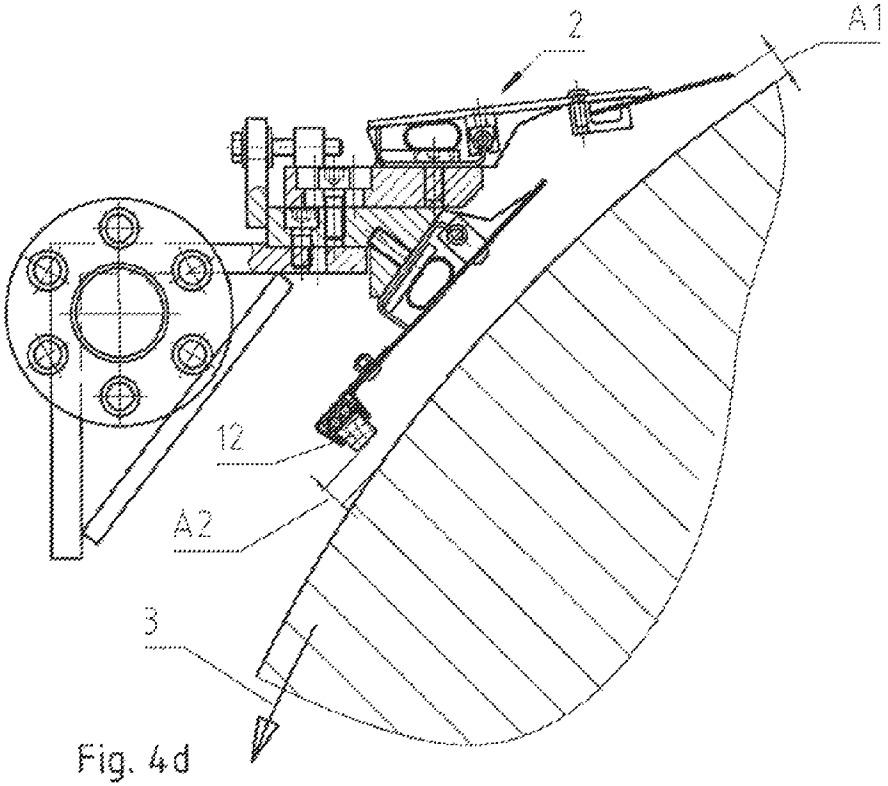
FIGS. 4*c* and 4*d* show illustrations of the embodiment according to FIG. 1*b* in the respective states, in which the application unit is placed against and lifted off the moving surface.
Figure 4C:
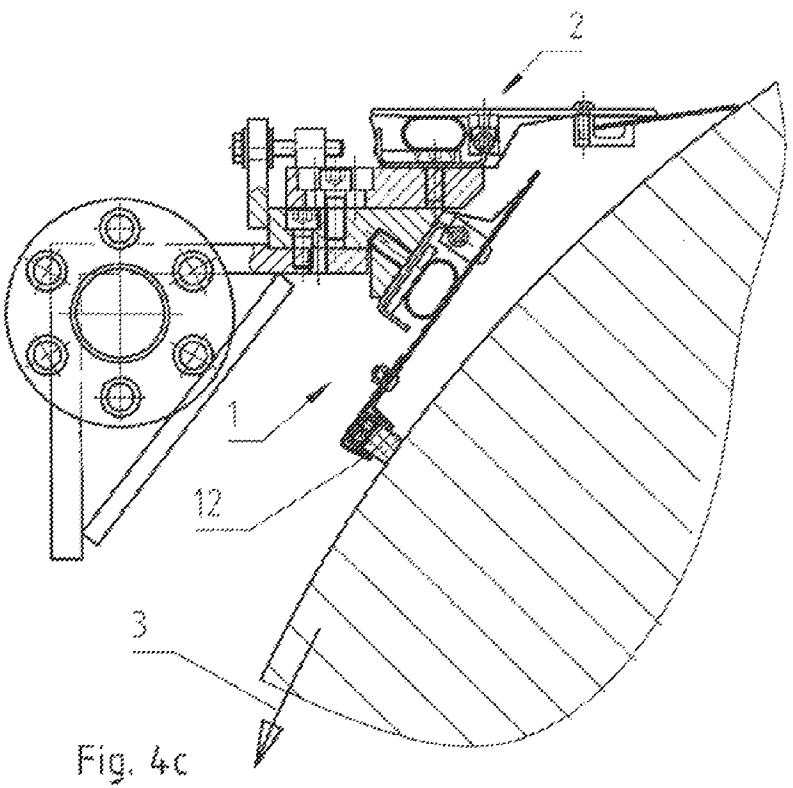

FIGS. 4*c* and 4*d* show the arrangement of the apparatus of FIG. 1*b* in the respective states according to FIGS. 4*a* and 4*b*, in which it is placed against and lifted off the moving surface.

FIG. 5 shows an exemplary application unit 1 that does not feature an additional cleaning device such as a scraper and wets a moving web 4, wherein the web is wrapped around a roll 31. The pad 12 contacts the web 4 while it is situated on the roll 31. For example, the moving web 4 consists of a screen that supports and guides a web-shaped product 41 such as, for example, a paper web while it passes through a plurality of cylinders 3. In this case, the application unit 1 wets the side of the web 4 that is in contact with the product.

FIG. 6 also shows an application unit 1 that wets a moving web 4, but the moving web 4 is not supported on a roll 31, but rather on a special supporting shoe 8. In this embodiment, the application unit is also illustrated by itself, i.e., without an additional cleaning device.

Figure 7A:
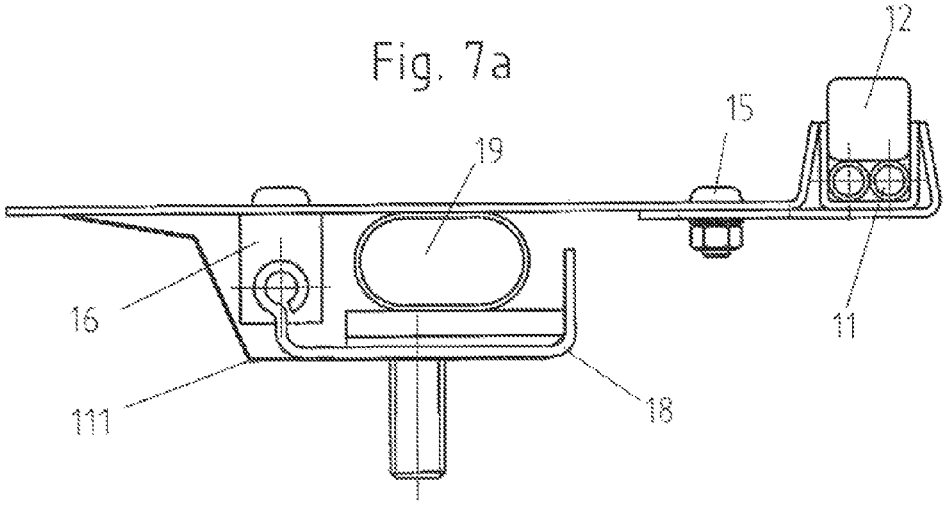
FIGS. 7*a* and 7*b* respectively show side views of an application unit with a fixed application element and with an exchanging rail for the application element.

FIG. 7*a* shows a side view of the embodiment of the application unit used in FIG. 1*b*, wherein the pad 12 is supplied with the application fluid via the pipes 11 and the pad 12 is accommodated in a double clamp that is fixed with the aid of a screw 15. The application unit can be pivoted with the aid of the bearing and the axle arranged thereon, wherein the application unit is placed against the moving surface by means of the load application hose 19 and lifted off by means of the spring 111. The base plate is identified by the reference symbol 18.

Figure 7B:
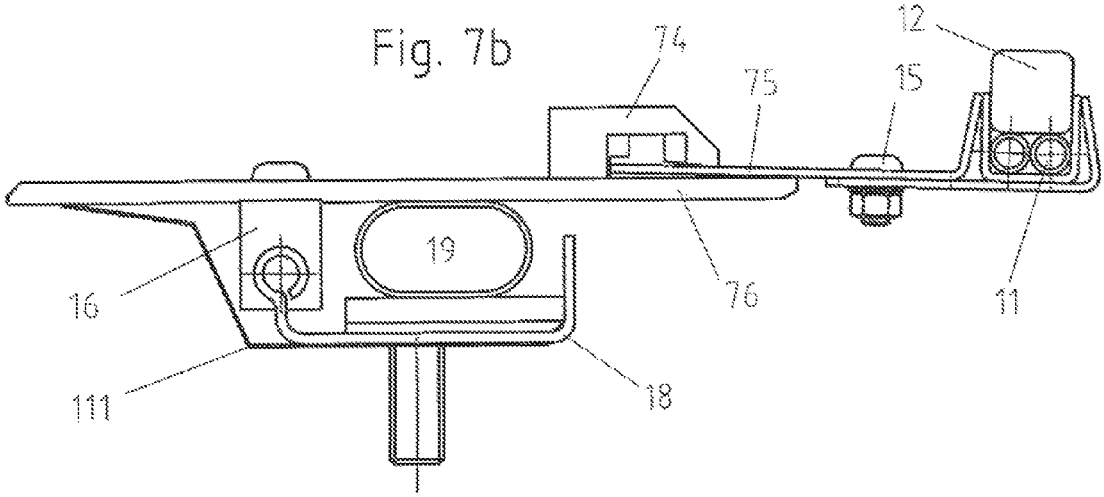

FIG. 7*b* shows an alternative embodiment, in which the application unit can be accommodated in an exchanging and fixing rail 74 with the plate 75, wherein the exchanging and fixing rail 74 is arranged on the counter plate 76. This arrangement provides the advantage of the embodiment according to FIG. 7*a*, namely that the application unit can be laterally pulled out of the mounting, such that a simple arrangement for carrying out maintenance or an exchange is realized. After the insertion of the application unit, it is at least non-positively connected to the exchanging and fixing rail 74 by means of corresponding fixing elements. Furthermore, other safety devices may be provided in order to prevent the connection from unintentionally separating. Elements with identical designs are identified by the same reference symbols.

Figure 8B:
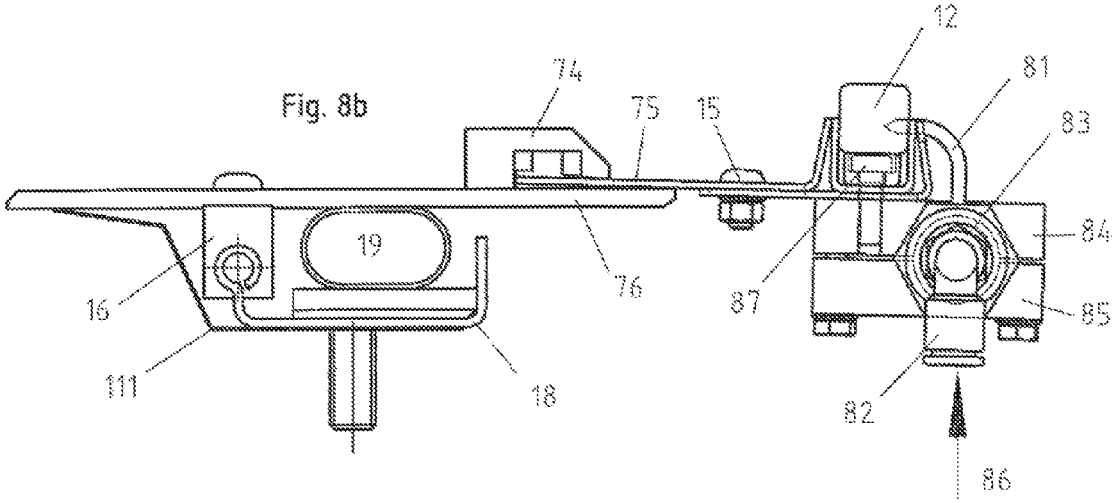

FIGS. 8*a* and 8*b* show another embodiment of the application unit in the form of illustrations that correspond to FIGS. 7*a* and 7*b*. FIGS. 8*a* and 8*b* can essentially be distinguished by the exchanging and fixing rail 74. In the application unit illustrated in these figures, the pad 12 is supplied with the fluid conveyed through the feed line 82 in the direction of the arrow 86 by means of a feed system that is arranged in an offset fashion. The lines are connected to one another by means of connecting elements 83 and to the application unit on the underside shown with the aid of clamping jaws 84 and 85. The fluid is introduced into the pad through connecting lines 81 that extend into the pad 12 in the form of needles. The clamping device of the pad can be fixed and, according to another preferred embodiment, the position of the pad can be determined with the aid of the screw 87.

Figure 9A:
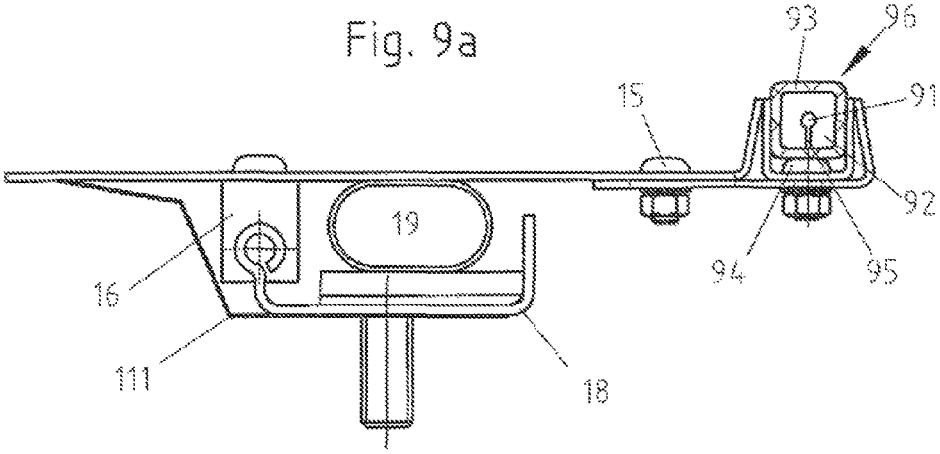
FIGS. 9*a* and 9*b* respectively show side views of another application unit with a fixed application element and with an exchanging rail for the application element.
Figure 9B:
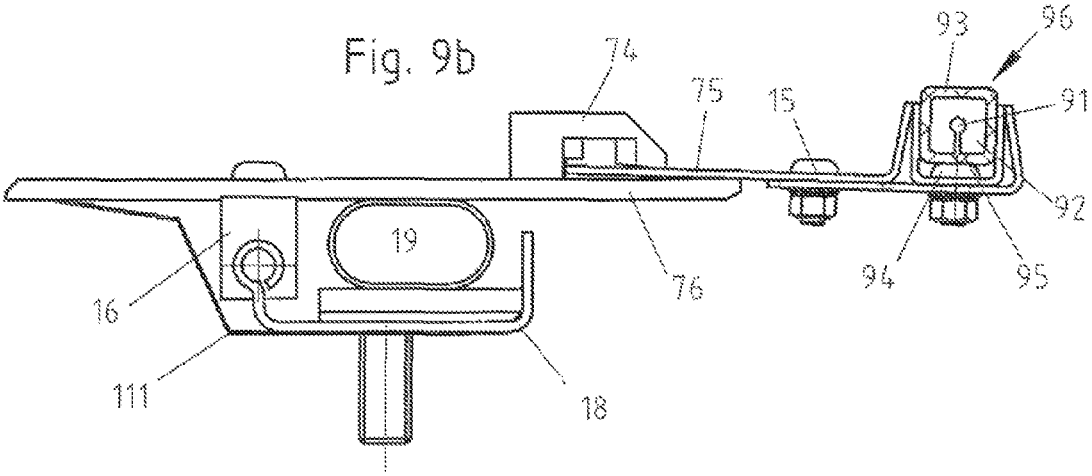

FIGS. 9*a* and 9*b* show another embodiment of the application unit in the form of illustrations that correspond to FIGS. 7*a* and 7*b*. FIGS. 9*a* and 9*b* can essentially be distinguished by the exchanging and fixing rail 74. According to the embodiments illustrated in FIGS. 9*a* and 9*b*, the fluid is introduced into the pad 96 through a channel 91 that is arranged in a core region 92 of the pad 96 and features connecting channels 95 leading to the outer region 93 of the pad 96. According to a particularly preferred embodiment, the pad may consist of two parts, wherein the core 92 may also be realized elastically and is covered with a fabric 93. Among other things, such a fabric may be particularly resistant to wear caused by the mechanical load and consist of a material, in particular, of the type used, among other things, for fabric bushing seals in pumps or the like. The shape of such a pad is furthermore not restricted to a square cross-sectional shape, but naturally also be realized round, rectangular or polygonal. The clamping device of the pad can be fixed and, according to another preferred embodiment, the position of the pad can be determined with the aid of the screw 94.

Figure 10A:
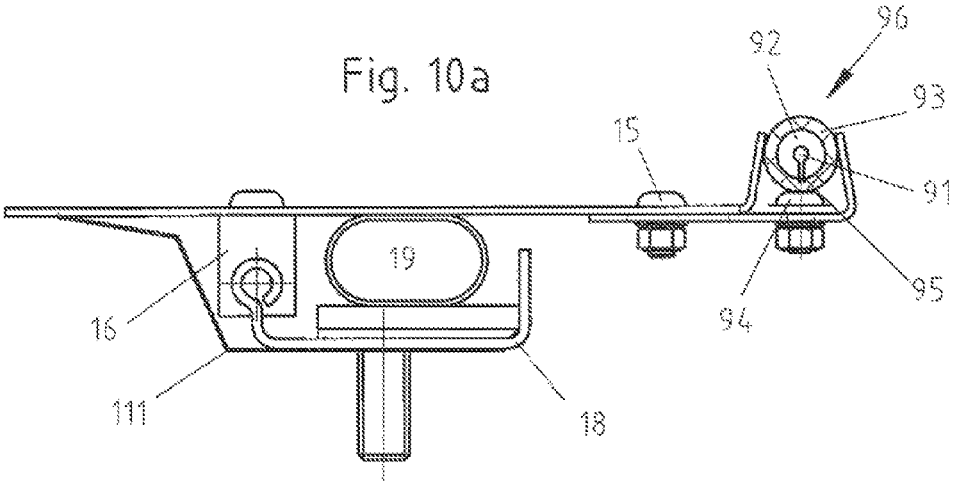
FIGS. 10*a* and 10*b* respectively show side views of another application unit with a fixed application element and with an exchanging rail for the application element.
Figure 10B:
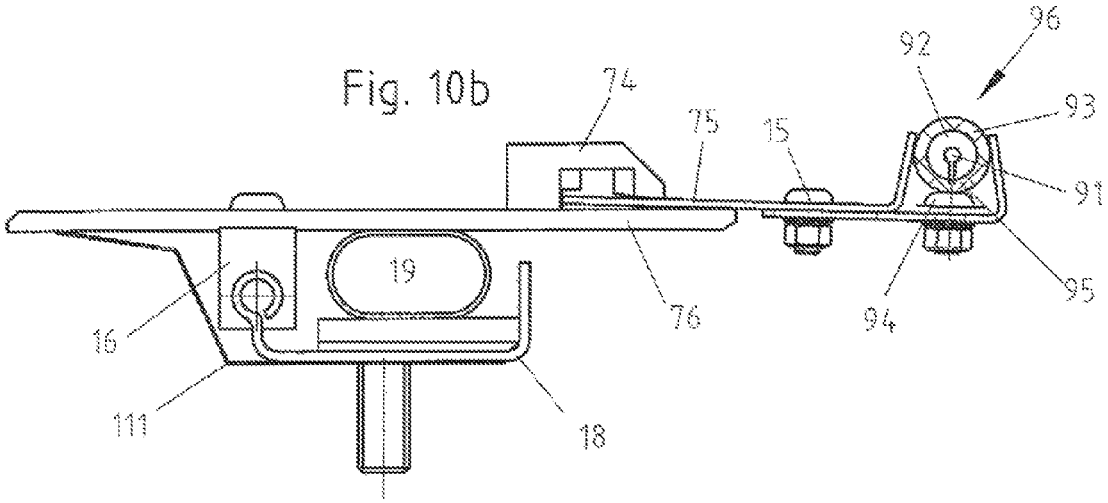

FIGS. 10*a* and 10*b* show another embodiment of the application unit in the form of illustrations that correspond to FIGS. 7*a* and 7*b*. FIGS. 10*a* and 10*b* can essentially be distinguished by the exchanging and fixing rail 74. The embodiment illustrated in these figures features a pad 96 that corresponds to the basic design according to FIGS. 9*a* and 9*b*, wherein the fabric has a round cross section in this case.

Figure 11A:
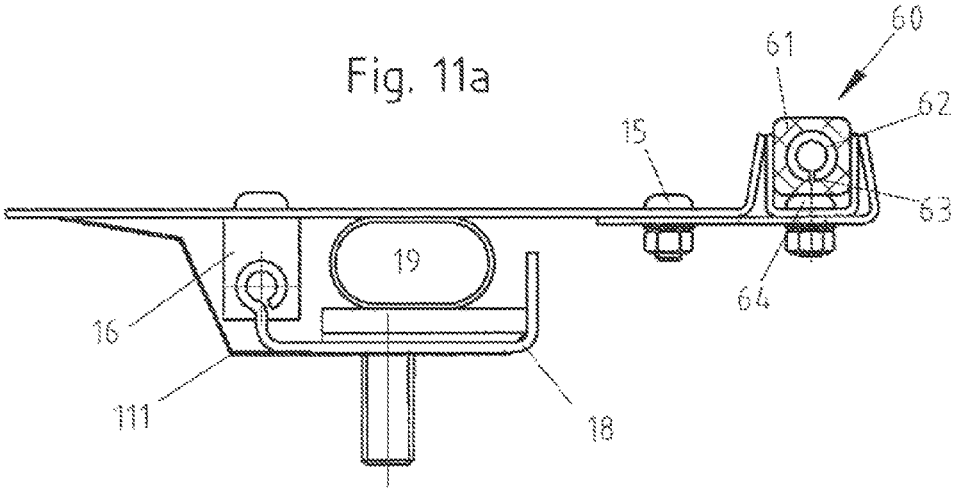
FIGS. 11*a* and 11*b* respectively show side views of another application unit with a fixed application element and with an exchanging rail for the application element.
Figure 11B:
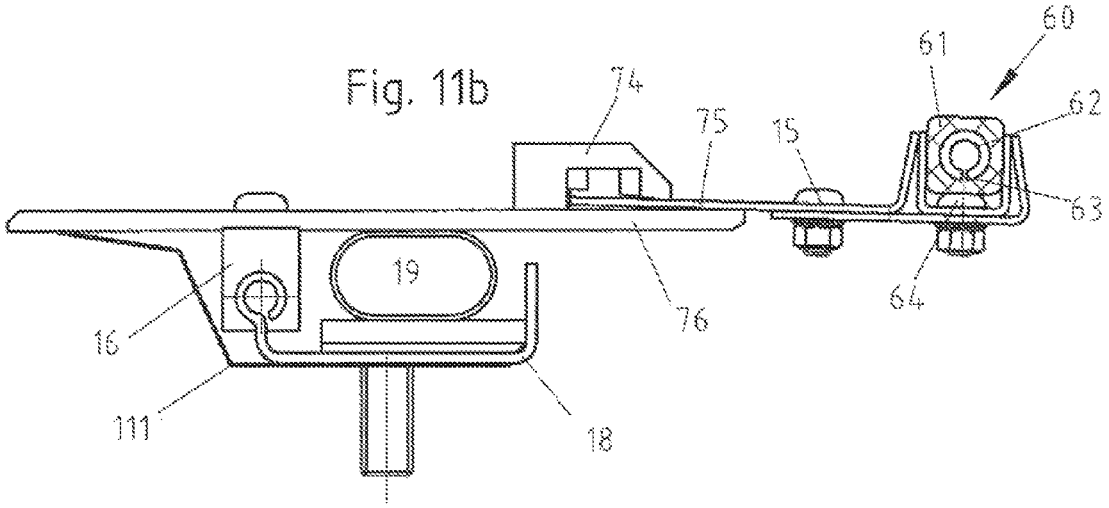

FIGS. 11*a* and 11*b* show another embodiment of the application unit in the form of illustrations that correspond to FIGS. 7*a* and 7*b*. FIGS. 11*a* and 11*b* can essentially be distinguished by the exchanging and fixing rail 74. The application unit illustrated in FIGS. 11*a* and 11*b* features a pad 60 that also consists of two parts. In this case, a hose 62 with openings 63 is accommodated in a fabric 61, wherein the hose is manufactured, in particular, of polyhalogen olefins such as, for example, PTFE material. It would naturally also be possible to utilize other plastics such as, for example, polyvinyl chloride, polyethylene, polypropylene, polystyrene, polyurethane, polyethylene terephthalate and the like. In this case, it also needs to be taken into consideration that the pad 60 may in this embodiment be once again realized with a square cross section—as shown—or a rectangular or even round cross section. The reference symbol 64 once again identifies a fixing screw for the clamp that can also be used, in particular, for positioning the pad. The scope of the present invention generally also includes embodiments, in which other suitable mounting options such as positive, integral and/or non-positive connections are used for the pad instead of the clamping device.

Figure 12A:
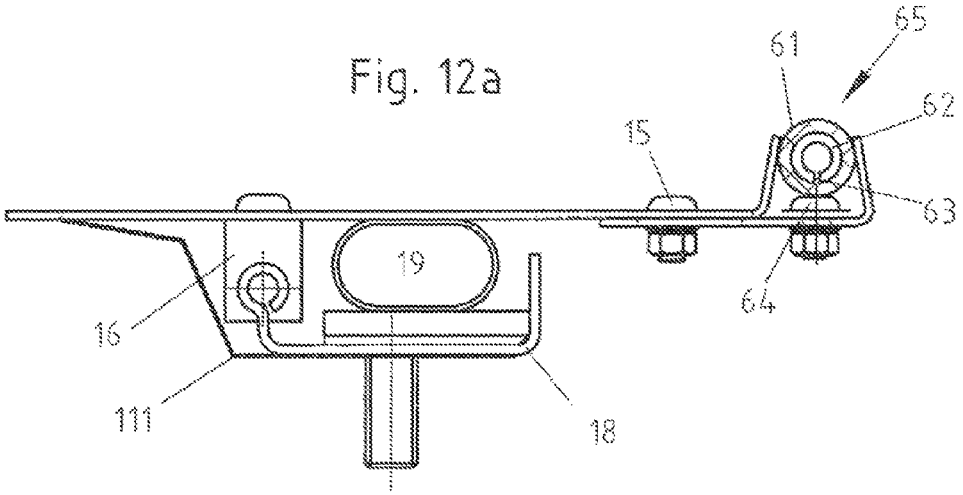
FIGS. 12*a* and 12*b* respectively show side views of another application unit with a fixed application element and with an exchanging rail for the application element.
Figure 12B:
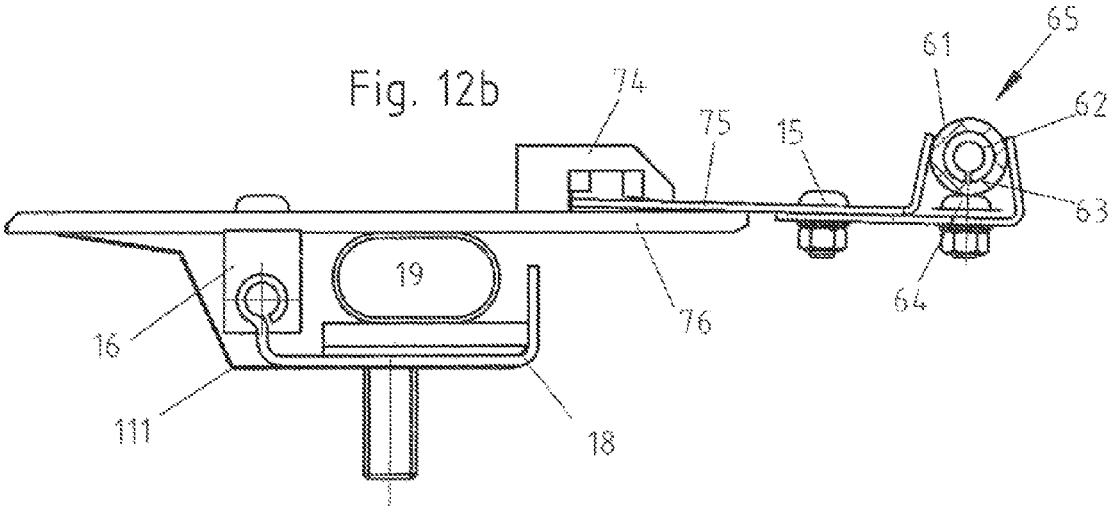

FIGS. 12*a* and 12*b* show another embodiment of the application unit in the form of illustrations that correspond to FIGS. 7*a* and 7*b*. FIGS. 12*a* and 12*b* can essentially be distinguished by the exchanging and fixing rail 74. The embodiment illustrated in these figures features a pad 65 that corresponds to the basic design according to FIGS. 11*a* and 11*b*, wherein the fabric has a round cross section in this case.

Figure 13A:
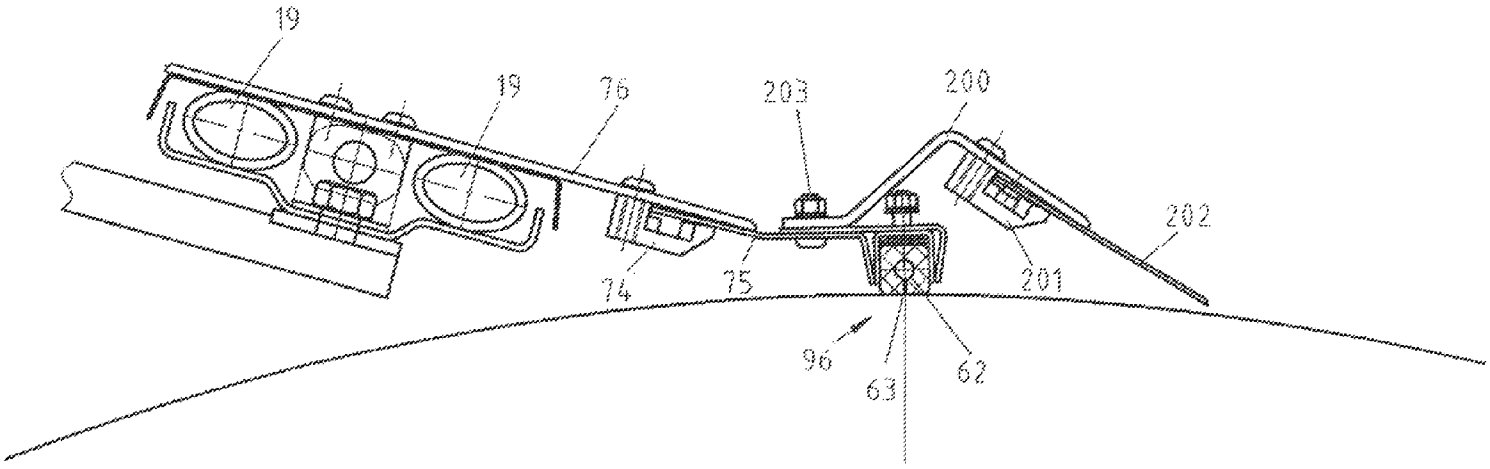
FIGS. 13*a* and 13*b* show another alternative embodiment of the application unit with a scraper in the respective positions, in which it is placed against and lifted off the moving surface.
Figure 13B:
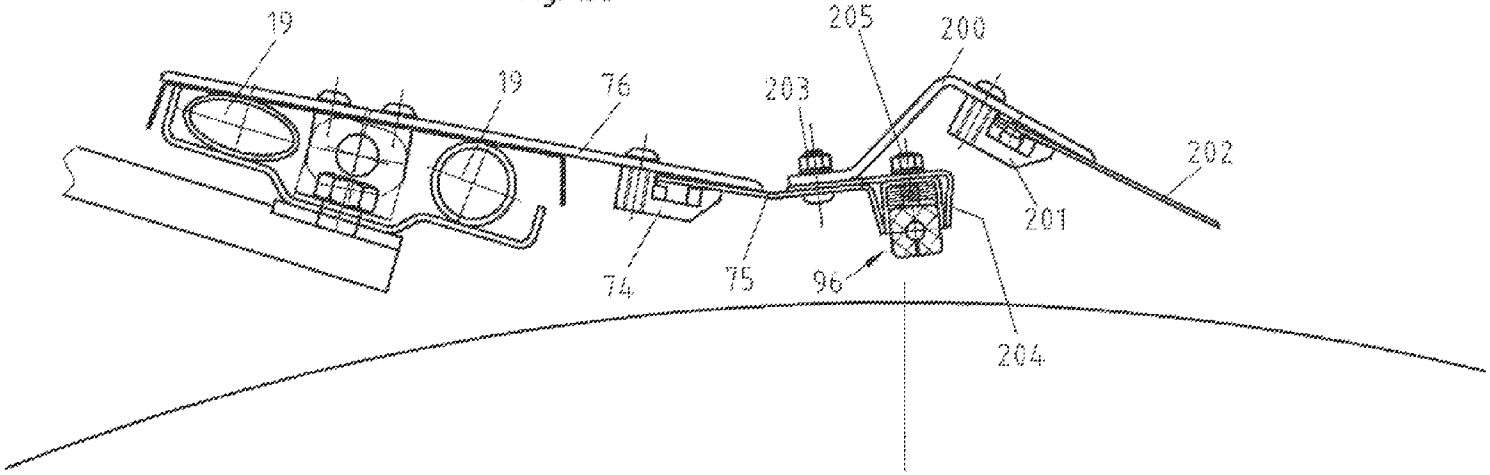

FIGS. 13*a* and 13*b* show another embodiment of the present invention, in which the application unit that includes the pad 96 is combined with a scraper 202 in a very compact fashion. In this case, FIG. 13*a* shows the position of the apparatus, in which it is placed against a roll surface, and FIG. 13*b* shows the lifted-off position of the apparatus.

According to the embodiment illustrated in these figures, the application unit is once again connected to the pivotable cross head with the aid of an exchanging and fixing rail 74, wherein said cross head can be actively raised, as well as pressed on, by means of the hoses 19. The application unit is connected to the exchanging and fixing rail 74 by means of the plate 75, wherein the screw 203 is not only used for fixing the clamping device for the pad 96, but also for fixing the scraper holder with the plate 200 and the exchanging and fixing rail 201 thereon. In the embodiment illustrated in these figures, the problem of the scraper shortening over its service life such that the pad is pressed against the surface with a greater force is also solved. In order to solve this problem, the pad 96 is prestressed by means of a spring 204, wherein the prestress can be adjusted by means of the set screw 205. This is illustrated particularly well in FIG. 13*b* because the unit is lifted off the roll surface and the pad 96 therefore is extended to the outermost position. The scope of the present invention naturally also includes embodiments, in which this spring is realized, in particular, in the form of a coil spring, a rubber element or a diaphragm.

The utilization and the application of such a system for readjusting an application element, particularly a pad, are not limited to the arrangement illustrated in the figures, particularly with respect to the combination with a scraper.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claim is:

1. An apparatus for applying a liquid active substance onto surfaces moving in a circulating fashion, comprising:

a metering unit with a pipe system, said pipe system including at least a feed pipe and a return pipe for the liquid active substance and an application unit including a pad having a length and having a rear side and a front side that faces a moving surface, at least the feed pipe with openings to introduce the active substance to an outer side of the feed pipe, the feed pipe and the return pipe extending longitudinally along the length of the pad are arranged on the rear side of the pad, and the pad having a length with an open-pore mesh structure which is capable of receiving and storing the active substance, capable of achieving saturation of the active substance over the length of the pad, and further capable of applying the active substance onto the moving surface as a film in dependence on the degree of saturation and a contact pressure of the pad, and wherein the pad consists essentially of a fabric structure capable of achieving saturation of the active substance when the active substance is introduced into the fabric structure through the openings in the at least one feed pipe, wherein the fabric structure consists essentially of at least one of threads, cords, strands, and fibers; and brackets accommodate and fix the pad, the feed pipe and the return pipe in a working position when the brackets are pushed together the feed pipe and the return pipe extending longitudinally directly next to each other in between the brackets under the pad, so that the pad applies the active substance onto the moving surface as a film in dependence on the degree of saturation and the contact pressure of the pad, and the brackets are capable of being pulled apart to exchange the feed pipe, the return pipe, and the pad.

2. The apparatus according to claim 1, wherein the liquid active substance is selected from a group consisting of: water or mixed solvent systems with aliphatic and/or aromatic, linear and/or cyclic, polar and/or non-polar solvent fractions, salts of monovalent or multivalent ions, acids and/or alkaline solutions, aqueous and oleiferous liquids, particularly saturated or unsaturated, open-chain or cyclic, normal or isomeric hydrocarbons, polymeric linear and/or cyclic alkyl siloxanes and alkyl aryl siloxanes and/or aryl siloxanes and/or their copolymers and/or cationic or quaternary and/or amphoteric silicone products and/or silicone derivatives, silicone oils, silicone greases, silicone tensides, silicone oil dispersants, silicone fluids, polydimethyl siloxane, polymethyl phenyl siloxane, oleiferous suspensions, oil emulsions, oil-in-water emulsions, water-in-oil emulsions, mineral oil, natural oils and fats, vegetable oil, animal oil, castor oil, coconut oil and/or tall oil and/or their derivatives, primary, secondary and tertiary or linear and/or branched, aliphatic and/or aromatic alcohols and/or ethers and/or esters derived thereof, betaines, lecithins, phospholipids, protein solubilisates and/or modified products thereof, wax emulsions, anionic, nonionic, amphoteric and/or cationic tensides, anionic, nonionic, amphoteric or cationic tenside-like and/or polymeric fluoric compounds, primary, secondary and tertiary alkyl amines and/or alkyl aryl amines, diamines and/or polyamines, alkyl and alkyl aryl amino oxides, imidazolinones and morpholines, quaternary ammonium compounds, ethoxylated, saturated and/or unsaturated fatty acids and/or their salts with monovalent and/or multivalent cations, esters, amines and/or amides of saturated and/or unsaturated fatty acids and/or fatty alcohols, alkyl and/or alkyl aryl phosphates, phosphonates, sulphates and sulphonates, alkyl ether and/or alkyl aryl ether phosphates and/or sulphates, alkyl and/or alkyl aryl sorbitans and/or polyols and glycerides, alkyl and/or alkyl aryl polyglycol ether and/or ester, wetting agents, antistatic agents, anti-friction agents, lubricants, emulsifiers, lipophilic and hydrophilic cleaning agents, lipophilic and hydrophilic solvents, alcohols, saturated fatty alcohols, unsaturated fatty alcohols, saturated fatty acids, unsaturated fatty acids, fatty-acid monalkyl esters, fatty-acid amides, fatty-acid monoalkyl amides, monoesters or polyesters of saturated or unsaturated monovalent or multivalent carboxylic acids, wax alcohols, glycols, benzene, isopropanols, toluene, aliphatic compounds, glycerides, anionic, non-ionic, amphoteric and/or cationic synthetic and/or natural polymers in dissolved and/or dispersed form, homo-polymerized and/or co-polymerized polyamines, polyesters, polyacrylates and/or polyalkylene glycols and/or alkyl polyglycols, anticorrosive agents, biocides and activators and/or catalysts and reactive precursors of release products that can be activated with UV-light and electron beams, or combinations thereof.

3. The apparatus according to claim 1, wherein the metering unit is capable of conveying the liquid active substance to the application unit in a continuous fashion.

4. The apparatus according to claim 1, wherein the liquid active substance is circulated in a circuit and tempered and/or mixed in a reservoir.

5. The apparatus according to claim 1, wherein the apparatus is arranged on a support system.

6. The apparatus according to claim 1, wherein the apparatus is combined with at least one cleaning system.

7. The apparatus according to claim 6, wherein the application unit and the cleaning system are arranged on a common cross head by adapter rails.

8. The apparatus according to claim 6, wherein the application unit is arranged downstream of the cleaning system.

9. The apparatus according to claim 6, wherein the application unit and/or the cleaning system are capable of being pivoted relative to the moving surface about at least one respective pivoting axis.

10. The apparatus according to claim 1, wherein at least the application unit includes at least one pressing system having a load application hose for pressing the application unit against the moving surface, and a lift-off system having a lift-off spring for lifting the application unit off the moving surface.

11. The apparatus according to claim 10, wherein the load application hose is inflated with air.

12. The apparatus according to claim 11, wherein the lift-off spring comprises a sheet metal strip that is folded once or several times.

13. The apparatus according to claim 6, wherein the application unit and/or the cleaning system are supported relative to the moving surface in a spring-loaded fashion.

14. The apparatus according to claim 6, wherein a distance between the application unit and the moving surface, in the lifted-off state, is greater than a distance between the cleaning system and the moving surface, in a lifted-off state.

15. The apparatus according to claim 1, wherein at least the application unit is arranged on a base plate and is capable of being laterally pulled out.

16. The apparatus according to claim 1, wherein the application unit is segmented over a width of the moving surface in order to realize a differentiated application of the liquid active substance.

17. The apparatus according to claim 1, wherein the fabric structure comprises at least one material that is selected from a group consisting of: woven fabrics, braided fabrics, layered fabrics, compressed fabrics or meshes thereof, or combinations thereof.

18. The apparatus according to claim 1, wherein the pad has a rectangular, polygonal, oval or round cross section.

19. A method for applying a liquid active substance onto a moving surface by an apparatus for applying a liquid active substance onto surfaces moving in a circulating fashion, comprising the steps of:

saturating an application unit with the liquid active substance; placing the application unit against the moving surface in order to produce a film; and lifting off the application unit; wherein the apparatus for applying a liquid active substance onto surfaces moving in a circulating fashion, comprises:

a metering unit with a pipe system, said pipe system including at least a feed pipe and a return pipe for the liquid active substance and the application unit including a pad having a length and having a rear side and a front side that faces a moving surface, at least the feed pipe with openings to introduce the active substance to an outer side of the feed pipe, the feed pipe and the return pipe extending longitudinally along the length of the pad are arranged on the rear side of the pad, and the pad having a length with an open-pore mesh structure which is capable of receiving and storing the active substance, capable of achieving saturation of the active substance over the length of the pad, and further capable of applying the active substance onto the moving surface as a film in dependence on the degree of saturation and a contact pressure of the pad, and wherein the pad consists essentially of a fabric structure capable of achieving saturation of the active substance when the active substance is introduced into the fabric structure through the openings in the at least one feed pipe, wherein the fabric structure consists essentially of at least one of threads, cords, strands, and fibers; and brackets accommodate and fix the pad, the feed pipe and the return pipe in a working position when the brackets are pushed together the feed pipe and the return pipe extending longitudinally directly next to each other in between the brackets under the pad, so that the pad applies the active substance onto the moving surface as a film in dependence on the degree of saturation and the contact pressure of the pad, and the brackets are capable of being pulled apart to exchange the feed pipe, the return pipe, and the pad.

20. The method according to claim 19, wherein the liquid active substance is continuously fed to the application unit.

21. The method according to claim 19, wherein the liquid active substance is conveyed in a circuit by means of the metering unit and tempered and/or mixed in a reservoir.

22. The method according to claim 19, wherein the application unit is only placed against the moving surface after a cleaning device has been placed against the moving surface.

* * * * *